US006289774B1

(12) United States Patent
Söderlund

(10) Patent No.: US 6,289,774 B1
(45) Date of Patent: Sep. 18, 2001

(54) MOBILE AUTOMATIC MACHINE FOR FASTENING OF FASTENERS

(76) Inventor: Roger Söderlund, Kalla Malkuma väg 18, S-692 72 Kumla (SE)

( * ) Notice: Subject to any disclaimer, the term of this patent is extended or adjusted under 35 U.S.C. 154(b) by 0 days.

(21) Appl. No.: 09/355,948

(22) PCT Filed: Dec. 18, 1998

(86) PCT No.: PCT/SE98/02217

§ 371 Date: Aug. 17, 1999

§ 102(e) Date: Aug. 17, 1999

(87) PCT Pub. No.: WO99/33606

PCT Pub. Date: Jul. 8, 1999

(51) Int. Cl.[7] ..... B25B 23/04
(52) U.S. Cl. ..... 81/430; 81/57.4
(58) Field of Search ..... 81/57.37, 430, 81/57.4

(56) References Cited

U.S. PATENT DOCUMENTS 2,316,747 * 4/1943 Stephens ..... 81/57.4
3,910,325 * 10/1975 Dixon ..... 81/57.37
3,929,176 * 12/1975 Dixon ..... 81/430
4,271,730 * 6/1981 Holl et al. ..... 81/57.4
5,123,158 * 6/1992 Dixon ..... 81/430
6,065,373 * 5/2000 Watanabe et al. ..... 81/57.4

* cited by examiner

*Primary Examiner*—Joseph J. Hail, III
*Assistant Examiner*—Joni B. Danganan
(74) *Attorney, Agent, or Firm*—Dennison, Scheiner, Schultz & Wakeman

(57) ABSTRACT

A mobile automatic machine for fastening fasteners which includes a rod mounted on wheels (11) and is attachable to and held in contact with a workpiece by a vacuum in suction cups (3) is disclosed. The fasteners are blown from a fastener feeder (14) through hoses (15) to a fastener driver (20) which includes a fastener holder (6). The fastener driver engages fasteners held by the fastener holder (6) and drives them into the workpiece under the control of a controller. The fastener driver (20) is slidably mounted on the rod and moves linearly at repeatable intervals or at a uniform speed along the entire length of rod (1) under the control of a controller. Other tools, such as drills or milling devices can substituted for the fastener driver.

1 Claim, 2 Drawing Sheets

MOBILE AUTOMATIC MACHINE FOR FASTENING OF FASTENERS

FIELD OF THE INVENTION

The present invention relates to a mobile automatic machine for fastening of fasteners, which machine may, for example, be attached by vacuum to a work object primarily for the purpose of securing fastener in panels, and is further designed to feed fasteners automatically in such manner that several fasteners can be inserted and fastened simultaneously. When using this automatic machine, the fasteners are inserted at intervals along a linear unit (1) at a preset spacing, which spacing can, however, be altered easily along the length of the unit.

BACKGROUND OF THE INVENTION

Panels are usually fastened together by means of screws supplied on a belt or picked up manually, and tightened with hand-held, power screwdrivers, a procedure which places a strain on the arms and shoulders. This is also a monotonous and time-consuming task since the panels are usually joined by about 10–15 screws per square meter and large numbers of screws must be installed in structures built from panels.

SUMMARY OF THE INVENTION

These problems are addressed by the present invention which comprises a rod attachable to a workpiece with suction cups, which rod supports a fastener driver for linear movement along the rod. A controller controls the rate and location of the driver on the rod and may move the driver at a constant or variable rate.

DETAILED DESCRIPTION OF A PREFERRED EMBODIMENT

Figure 1:
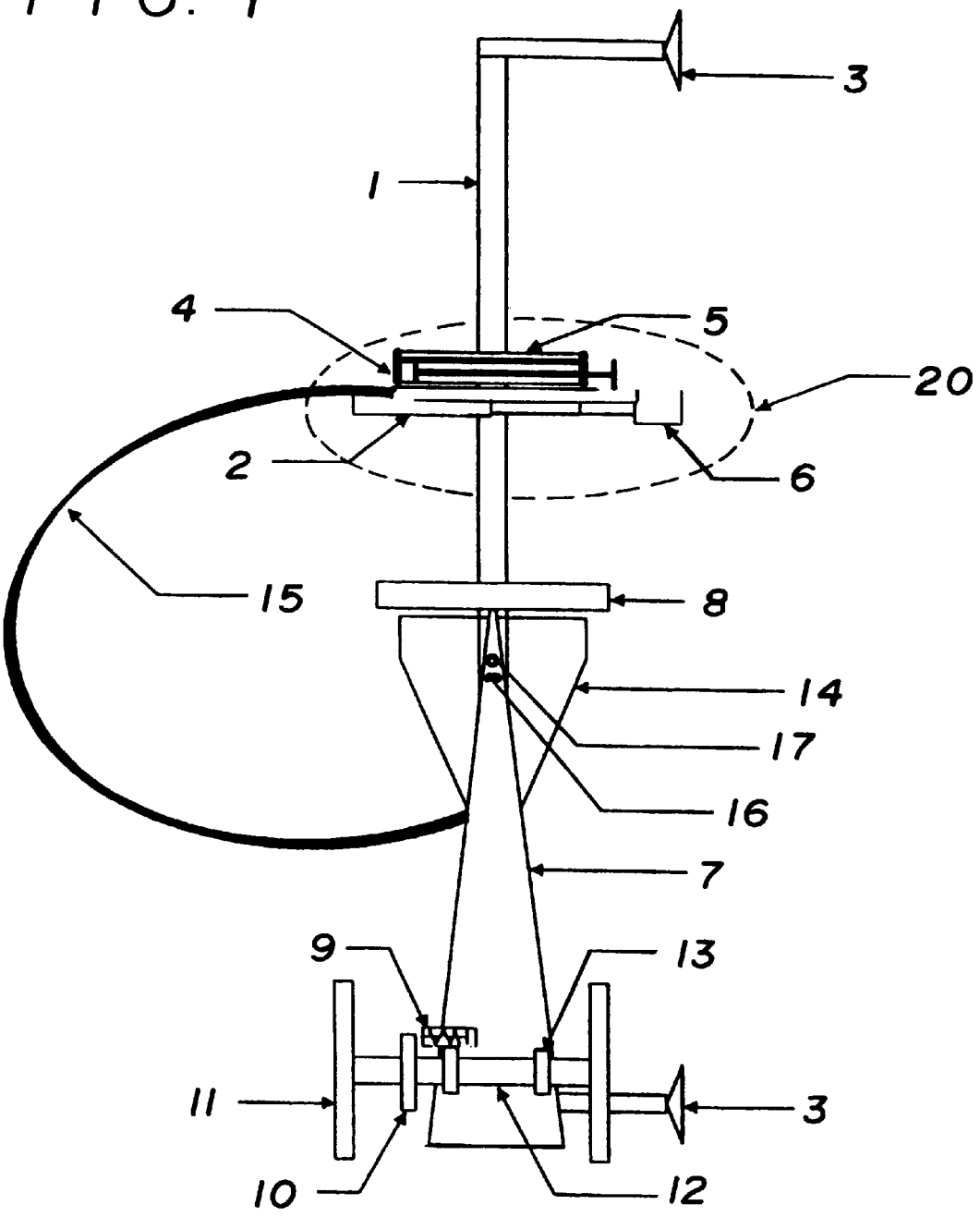
FIG. 1 is a side elevation view of an automatic fastening device according to the present invention; and, FIG. 2 is a front elevation view of the fastening device of FIG. 1.

The reference numbers stated on the figures indicate the following: Linear unit 1, motors 2, suction cups 3, compressed air cylinder 4, work head holder 5, fastener holder 6, control box 7, handle 8, compressed air cylinder 9, counter-stop 10, wheels 11, axle 12, bearing 13, fastener arranger 14, hoses 15, starter button 16, pushbutton 17 and work head 20.

Figure 2:
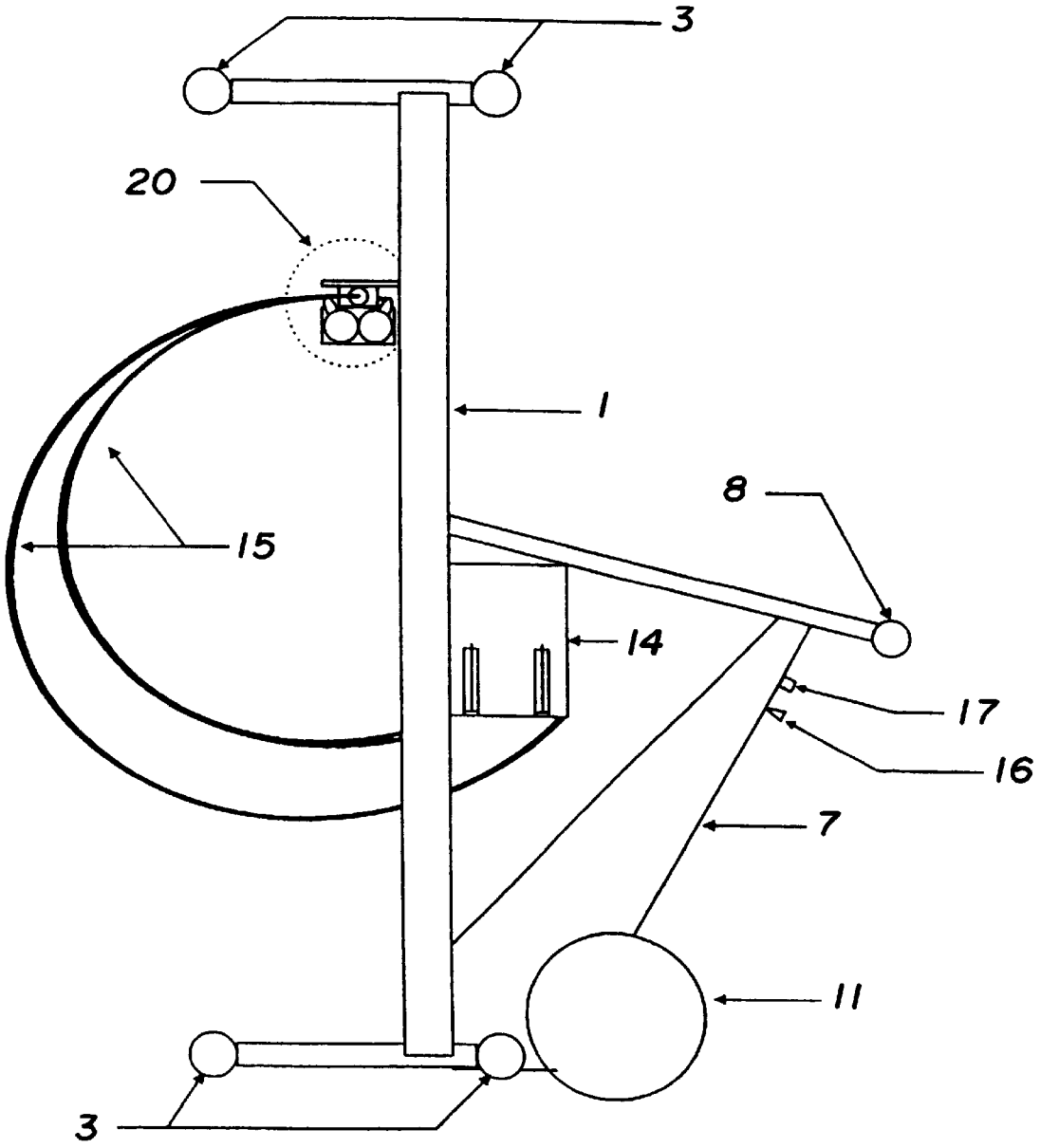

FIGS. 1 and 2 show a fastening device according to the present invention. Designated 1 on the figures, the linear unit is the part on which the work head 20 moves between first and second end positions when installing the fasteners. When starter button 16 is operated, the fastener arranger 14 is started and the cylinder 9 presses the automatic fastening device against the panel. A pump or other suitable device removes air from the suction cups to hold the automatic fastening device in contact with the work object. Pushbutton 17 is activated when the correct vacuum has been reached and only then can screw tightening be commenced. At this point, the screws shall already have been placed in the fastener holder 6 by an operator prior to operating the fastening device, or as is the case in subsequent cycles, have already been blown into the fastener holder from fastener arranger 14 through a plurality of hoses 15. The air from compressed air cylinder 4 is used to move the fastening device against the panel, the motors 2 starting only when the correct contact pressure with the panel has been reached. The screws are screwed in to a predetermined depth. When the screws have been tightened to the correct depth, the air from the compressed air cylinder is used to move the work head holder 5 away from the panel while new screws are blown into the fastener holder 6 and the work head 20 is traversed along the linear unit 1 to the next position. When the work head 20 has reached the last position, new screws are blown into the fastener holder 6 and the work head 20 is traversed to the other end of the linear unit 1 in readiness for the next cycle. A controller 7 controls the motion of the work head 20 to move it in stepped intervals or at an uniform speed.

PURPOSE OF INVENTION

The main purpose of the present invention is to install and tighten panel screws, primarily as part of building and installation works, and to reduce the occupational injuries which occur when the task is carried out using hand-held tools, also to save time by installing a number of screws simultaneously. In addition, other working tasks can be carried out while changing the working head (20).

What is claimed is:

1. A mobile automatic machine for inserting fasteners into a panel of material comprising:

a rod;

at least one suction cup attached to said rod for holding said rod on the panel;

a fastener arranger connected to said rod;

a work head slidable connected to said rod, said work head including a fastener holder;

a plurality of hoses connected between said fastener arranger and said fastener holder;

a compressed air cylinder for blowing fasteners from said fastener arranger to said fastener holder through said plurality of hoses; and, a controller for controlling the position of said work head on said rod, the feeding of fasteners to said fastener holder, and the driving of fasteners in said fastener holder by said work head.

* * * * *